US009381530B2

(12) United States Patent
Moretti

(10) Patent No.: US 9,381,530 B2
(45) Date of Patent: Jul. 5, 2016

(54) DISPENSING DEVICE FOR FLUID SUBSTANCES

(75) Inventor: Matteo Moretti, Crema (CR) (IT)

(73) Assignee: LUMSON S.P.A., Capergnanica (CR) (IT)

( * ) Notice: Subject to any disclaimer, the term of this patent is extended or adjusted under 35 U.S.C. 154(b) by 792 days.

(21) Appl. No.: 13/257,537

(22) PCT Filed: Mar. 19, 2009

(86) PCT No.: PCT/EP2009/002023

§ 371 (c)(1),
(2), (4) Date: Sep. 19, 2011

(87) PCT Pub. No.: WO2010/105642

PCT Pub. Date: Sep. 23, 2010

(65) Prior Publication Data

US 2012/0018538 A1 Jan. 26, 2012

(51) Int. Cl.

| | |
|---|---|
| ***B65D 25/40*** | (2006.01) |
| ***B05B 11/00*** | (2006.01) |
| ***B65D 83/14*** | (2006.01) |

(52) U.S. Cl.

CPC ..... *B05B 11/0067* (2013.01); *B05B 11/0072* (2013.01); *B65D 83/7535* (2013.01)

(58) Field of Classification Search

CPC ..... B05B 11/0067; B05B 11/3077; B05B 11/0072; B65D 83/7535; B65D 83/44

USPC ..... 239/459, 456, 453, 452, 337, 340, 461

See application file for complete search history.

(56) References Cited

U.S. PATENT DOCUMENTS

| | | | | |
|---|---|---|---|---|
| 4,830,284 | A | 5/1989 | Maerte | |
| 5,273,191 | A | 12/1993 | Meshberg | |
| 5,558,258 | A * | 9/1996 | Albini et al. | 222/496 |
| 5,842,616 | A * | 12/1998 | Ruscitti et al. | 222/321.3 |
| 6,161,732 | A * | 12/2000 | Albini | 222/321.3 |
| 6,824,021 | B2 * | 11/2004 | Masuzzo et al. | 222/321.7 |
| 2009/0084872 | A1 | 4/2009 | Vanblaere et al. | |

FOREIGN PATENT DOCUMENTS

| | | |
|---|---|---|
| EP | 1 834 701 | 9/2007 |

OTHER PUBLICATIONS

International Search Report Issued Oct. 13, 2009 in PCT/EP09/002023 filed Mar. 19, 2009.

* cited by examiner

*Primary Examiner* — Arthur O Hall
*Assistant Examiner* — Juan C Barrera
(74) *Attorney, Agent, or Firm* — Vorys, Sater, Seymour and Pease LLP

(57) ABSTRACT

A dispensing device for fluid substances, including a push-button in which a chamber is provided housing a piston, the piston being loaded by an elastic mechanism to urge a front projecting appendix thereof into a dispensing hole for the substance, to hence sealedly close the hole, the pushbutton presenting a seat enabling a hollow stem to be coupled there-through through which the pressurized substance is fed to the device. In the chamber there is housed an at least partially cylindrical member in an interior of which the piston slides, in the member there being provided at least one passageway opening to the front of the piston and communicating with a bore of the stem when the device is positioned on the pump.

13 Claims, 2 Drawing Sheets

DISPENSING DEVICE FOR FLUID SUBSTANCES

BACKGROUND OF THE INVENTION

1. Field of the Invention

The present invention relates to a dispensing device for fluid substances.

More particularly it relates to a dispensing device for fluid substances both in the form of cream and in the form of less viscous products such as sprays, deodorants and the like.

2. Discussion of the Background

In the known art a pushbutton is fixed to a hollow stem projecting from a container. Channels connecting the stem bore to a product dispensing hole are provided in the pushbutton. When dispensing is required, pressurized fluid withdrawn from a container is fed into the stem bore. Downstream of the stem there can be provided either a conventional pump operated by pressing the pushbutton, or a valve which is normally closed but opens on pressing the pushbutton; in this latter case the vessel containing the substance to be dispensed must be under pressure.

This known art has the drawback that on termination of a dispensing operation, all the residual product in the stem and in the pushbutton conduits upstream of the dispensing hole is in contact with air; it can therefore dry out or deteriorate and block the pump or valve and hence prevent correct product dispensing on subsequent use.

To obviate these known problems devices have been conceived such as those described in EP0803294. That document describes a dispensing device comprising a dispensing pushbutton in which a piston is provided from which there projects a stem which when in the non-dispensing position closes the dispensing hole. In this manner the product contained in the stem and in the conduits provided within the pushbutton is isolated from the air, the device hence being not subject to malfunction deriving from incrustations which can form in said conduits.

However the aforesaid device (as in the case of many others present in the known art) presents considerable drawbacks.

It is extremely difficult to mould the pushbutton, usually of plastic, because considerable thickness changes are present in proximity to the joint between the chamber in which the piston slides and the cylindrical portion by which the pushbutton fits onto the stem. These thickness variations generate residual stresses in the moulding, leading to ovalization in that region in which the piston is housed and slides.

This creates considerable problems for the seal between the piston lip and that conduit surface along which the piston slides.

SUMMARY OF THE INVENTION

An object of the present invention is therefore to provide a dispensing device which represents an improvement over the known art, and which in particular overcomes the sealing problems present in the aforedescribed solutions.

A further object of the present invention is to provide a device of simpler construction which enables the piston to operate and slide in an optimal manner.

These and other objects are attained by a dispensing device for fluid substances formed in accordance with the technical teachings of the accompanying claims.

BRIEF DESCRIPTION OF THE DRAWINGS

Further characteristics and advantages of the invention will be apparent from the description of a preferred but non-exclusive embodiment of the dispensing device for fluid substances illustrated by way of non-limiting example in the accompanying drawings, in which.

DETAILED DESCRIPTION OF THE PREFERRED EMBODIMENTS

Figure 2:
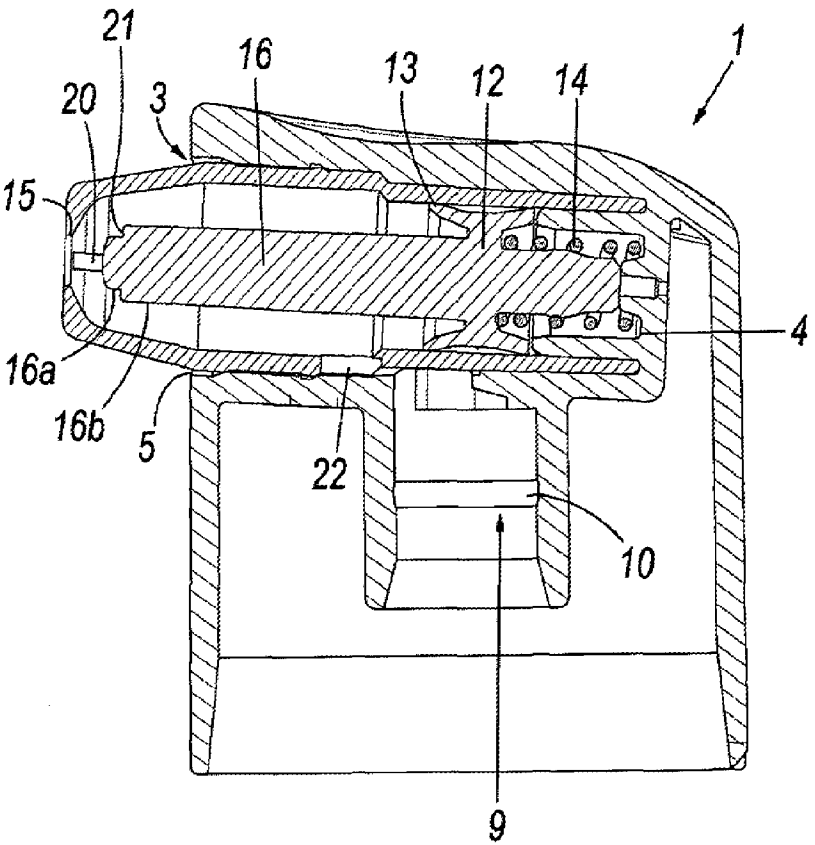
FIG. 2 is a section through the device of FIG. 1 in a dispensing position.

With reference to said figures, these show a dispensing device indicated overall by the reference numeral 1.

It comprises a pushbutton formed preferably of plastic material by moulding. A transverse chamber 3 presenting a frontal aperture 5 is provided in its interior. An annular seat 6 is provided on the end 4 of the chamber 3, from which end there projects an abutment 7 the use of which is clarified hereinafter. In the end there is also provided an air passageway 8 communicating with the outside.

Figure 1:
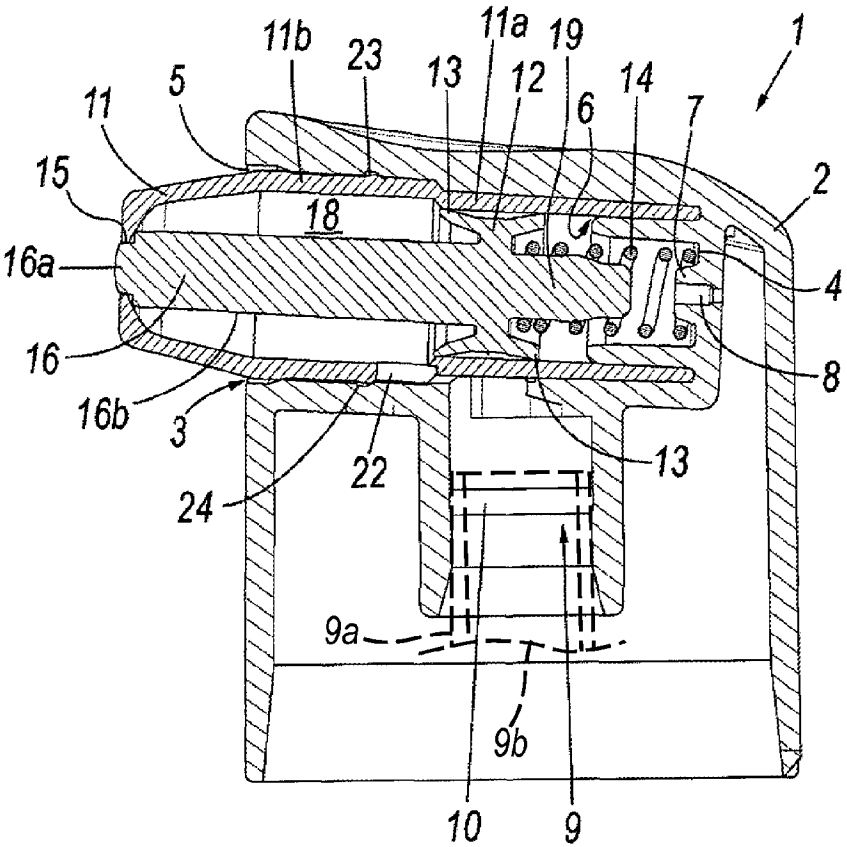
FIG. 1 is a section through a device of the present invention in a non-dispensing position.

The pushbutton 2 comprises a seat 9, in the wall of which there is an annular groove 10. This seat 9 is arranged to receive and clamp by means of the groove a hollow stem 9*a* having a bore 9*b* (see FIG. 1) through which the substance to be dispensed is fed to said device. This substance passes through the stem bore under pressure. Hence the stem can be either that of a conventional dispensed pump or that for operating a valve associated with a pressurized vessel of known type. A member 11 for closing the chamber 3 is fitted into the chamber 3. The member 11 presents a cylindrical portion 11*a*, preferably of circular cross-section, which fits onto the end of the chamber 3, namely into the annular seat 6. Interference is provided between the annular seat 6 and the cylindrical portion 11 a to ensure a perfect seal between the parts. Annular projections can be provided on the surfaces of the annular seat to improve the seal between the seat and the member 11.

The member 11 also presents a widened front portion 11 b carrying at its end a dispensing hole 15 provided axially to the member 11. A piston 12 movable against an elastic means (specifically a spring) is present within the cylindrical portion 11*a*.

On its front part the piston 12 presents a first lip 13*a* arranged to seal against the cylindrical portion 11*a*, and a rear second lip 13*b* having merely a guide function in the illustrated example. The piston also presents, projecting frontally from it, an appendix 16 for sealedly closing the hole 15 when inserted therein. Essentially the piston/appendix combination forms a valving element for the hole 15. The spring 14 is specifically positioned between the piston 12 and the end of the chamber 3 in such a manner as to urge the appendix 16 into the hole 15.

The member 11 presents a passageway 22 which connects the front part of the piston, from which the appendix 16 extends, to the stem bore when the device is positioned on it, hence enabling a pressurized fluid originating from the stem to flow between the front surface of the piston and the dispensing hole Operating the pushbutton causes the compartment 18 to fill. When the pressure in the compartment 18 is such as to overcome the resistance of the spring 14 the piston withdraws to its end-of-stroke position and the appendix 16 frees the hole 15 to hence enable the substance to be dispensed. The end-of-stroke position is shown in FIG. 2; in it can be seen a projection 19 protruding from the rear end of the piston to rest against the end of the chamber 3 (specifically against the abutment 7) precisely to define this end-of-stroke position of the piston. Any air which may be present between the rear of the piston 12 and the end of the chamber 3 escapes through the air passageway 8 during withdrawal of the piston 12.

It should be noted that the appendix 16 is set and maintained coaxial to the hole 15 by suitable ribs 20 visible in FIG. 2 and cooperating with an outer surface 16*b* of the appendix 16. In the present embodiment the ribs are three in number and are disposed 120° apart, but can be of any number and can assume any configuration. The appendix 16 also presents a seal portion 16*a* suitable to penetrate into the hole 15 to sealedly close it, and is connected to the guide surface 16*b* by a step 21 which acts as an abutment and a stop for the piston stroke when the pressure within the compartment 18 falls below that provided by the spring 14, consequently the piston advancing to urge the appendix 16 in the hole 15 into the closure position. In this situation the fluid within the pushbutton 2 and in the stem interior is isolated from the external environment.

Advantageously the compartment 18 has a considerable volume and a passage cross-section much greater than that defined by the passageways 22 and by the stem bore. Consequently the fluid is able, during dispensing, to slow down considerably within this compartment 18. This is very positive particularly when the fluid product to be dispensed is a cream or a foam.

In conclusion it should be noted that the member 11 presents on its surface an annular projection 23 preferably but not necessarily cooperating with a suitable groove 24 provided in the surface of the chamber 3 for sealedly fixing the member to the pushbutton 2 by interference.

The assembly of a device conceived in this manner is very simple. This is done by inserting the piston 12 into the member 11, mounting the spring about the projection 19 and inserting the combination into the chamber 3.

Advantageously, in the present invention the inner surface of the chamber 3 does not necessarily have to be perfectly cylindrical and can present ovalization phenomena, which however do not compromise the functionality of the device in question. This is because the seal for the piston 12 is effected against a part 11 which does not present any shape irregularities as it is formed in one piece, is easily mouldable and, because of its shape, is easy to form without shape defects or residual stresses which could lead to ovalizations. The member 11 is fixed to the cylinder both by the annular seat 6 and by the annular projection 23A provided in its front portion.

In particular, that region of the member 11 involved in the sliding of the piston is not used for fixing the piece 11 to the pushbutton; advantageously between that region and the pushbutton a clearance is provided which does not enable any ovalized walls of the chamber 3 to deform the member 11 in that region.

Figure 4:
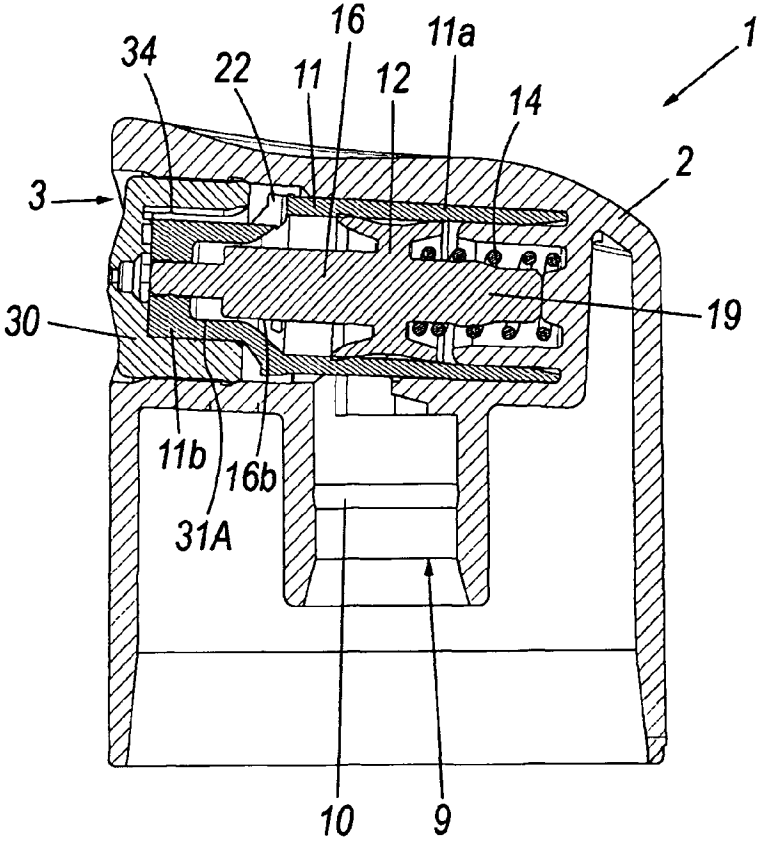
FIG. 4 is a section through the device of FIG. 3 in a dispensing position.
Figure 3:
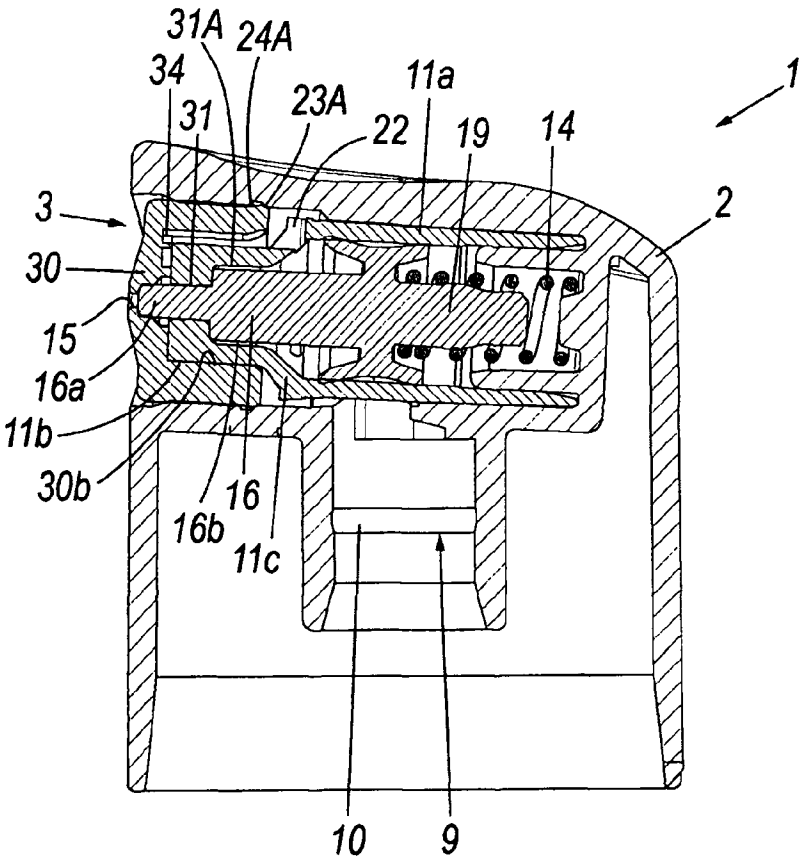
FIG. 3 is a section through an alternative embodiment of the device of the present invention in a non-dispensing position.

The alternative embodiment illustrated in FIGS. 3 and 4 is particularly suitable for use with substances of low viscosity such as deodorant sprays etc., which have to be atomized during dispensing.

Those parts functionally similar to the parts already described previously are indicated by the same reference numerals, and their description will not be repeated.

The pushbutton 2 comprises a member 11 presenting a cylindrical portion 11*a* from which a frusto-conical portion 11*c* extends, connected to a front portion 11*b*. A passageway 22 functionally similar to that of the preceding embodiment is provided in the frusto-conical portion. The front portion 11*b* in this case has a diameter less than the cylindrical portion 11*a* and is inserted into a plug 30 which frontally closes the chamber 3 in which the dispensing hole 15 is provided. The plug 30 is fixed to the member 11 by an annular projection 23A which by interference sealedly engages those surfaces defining the chamber 3 in which a suitable groove 24A is also suitably provided. A hole 31 is axially provided in the front portion 11*b* to act as a guide means for the appendix 16 (cooperating with its outer surface 16B) and has the same function as the previously described ribs 20.

Also in this case the appendix 16 presents a peg-like sealing portion 16A which besides blocking the dispensing hole 15 provided in the member is sealedly slidable in a hole 31 provided in the portion 11*b* facing the dispensing hole 15.

Advantageously at the interface surface between the plug 30 and the front portion 11*b* of the member 11 there is provided at least one passageway 34 communicating with the chamber 3 and arranged to conventionally generate a vortex flow of the fluid to be dispensed.

Again in this embodiment there is provided, in the end of the chamber 3, an escape hole for any air present between the rear part of the piston 12 and the end of the chamber 3.

The invention claimed is:

1. A dispensing device for fluid substances, comprising;

a pushbutton in which a chamber is provided, the chamber housing a piston, the piston being loaded by an elastic device to urge a front projecting appendix thereof into a dispensing hole for the substance, to hence sealedly close the dispensing hole, the pushbutton presenting a seat enabling a hollow stem to be coupled therethrough through which the pressurized substance is fed to the dispensing device, wherein in the chamber there is housed an at least partially cylindrical member, wherein the member frontally closes the chamber, and the member being in an interior of which the piston slides, in the member there being provided at least one passageway opening to a front of the piston and communicating with a bore of the stem when the dispensing device is positioned on the stem, such that the pressurized substance originating from the stem, by passing through the passageway, is configured to cause the piston to withdraw and hence free the hole, to dispense the substance, and wherein the piston presents a first sealing lip in proximity to its front portion and a guiding second lip extending from a rear portion of the piston, the at least partially cylindrical member being configured such that, when the piston is in an end-of-stroke position, the guiding second lip is internal to the member; and, wherein the piston presents in its rear portion a projection which rests on the end of the chamber when the piston is in its end-of-stroke position.

2. A device as claimed in claim 1, wherein on the end of the chamber an annular seat is provided to sealedly house the member, at least partially, and to maintain it in position.

3. A device as claimed in claim 1, wherein the dispensing hole is provided frontally in the member.

4. A device as claimed in claim 1, wherein the dispensing hole is provided in a plug that frontally closes the chamber.

5. A device as claimed in claim 4, wherein the plug comprises a housing for the member and at least one projection cooperating with the surface of the chamber to sealedly fix the plug to the pushbutton.

6. A device as claimed in claim 4, wherein between the plug and the front portion of the member at least one passageway is provided communicating with the chamber to generate a vortex movement of the fluid to be dispensed.

7. A device as claimed in claim 1, wherein the member presents guide means for the appendix.

8. A device as claimed in claim 7, wherein the guide means comprises ribs provided in proximity to the hole.

9. A device as claimed in claim 7, wherein the guide means comprises a hole provided in a front portion of the member.

10. A device as claimed in claim 1, wherein in the front portion of the member a chamber is provided within which the substance to be dispensed reduces its velocity before being dispensed.

11. A device as dairned in claim 1, wherein the appendix presents a seal portion for closing the hole, and a guide surface cooperating with the guide means.

12. A device as claimed in claim 1, wherein the member presents at least one projection cooperating with the surface of the chamber to sealedly fix the member to the pushbutton.

13. A dispensing device for fluid substances, comprising;

a pushbutton in which a chamber is provided, the chamber housing a piston, the piston being loaded by an elastic device to urge a front projecting appendix thereof into a dispensing hole for the substance, to hence sealedly close the dispensing hole, the pushbutton presenting a seat enabling a hollow stem to be coupled therethrough through which the pressurized substance is fed to the dispensing device, wherein in the chamber there is housed an at least partially cylindrical member, wherein the member frontally closes the chamber, and the member being in an interior of which the piston slides, in the member there being provided at least one passageway opening to a front of the piston and communicating with a bore of the stem when the dispensing device is positioned on the stem, such that the pressurized substance originating from the stem, by passing through the passageway, is configured to cause the piston to withdraw and hence free the hole, to dispense the substance, and wherein the piston presents a first sealing lip in proximity to its front portion and a guiding second lip extending from a rear portion of the piston, the at least partially cylindrical member being configured such that, when the piston is in an end-of-stroke position, the guiding second lip is internal to the member; and, wherein the piston presents in its rear portion a projection which rests on an abutment at the end of the chamber when the piston is in its end-of-stroke position.

* * * * *